US010836062B2

(12) United States Patent
Perini

(10) Patent No.: US 10,836,062 B2
(45) Date of Patent: Nov. 17, 2020

(54) APPARATUS FOR TRIMMING PAPER ROLLS OR LOGS AND AN OPERATING METHOD FOR TREATING THE LOGS

(71) Applicant: Fabio Perini, Viareggio (IT)

(72) Inventor: Fabio Perini, Viareggio (IT)

( * ) Notice: Subject to any disclaimer, the term of this patent is extended or adjusted under 35 U.S.C. 154(b) by 1394 days.

(21) Appl. No.: 14/143,428

(22) Filed: Dec. 30, 2013

(65) Prior Publication Data

US 2014/0113791 A1 Apr. 24, 2014

Related U.S. Application Data

(60) Continuation of application No. 12/145,700, filed on Jun. 25, 2008, now abandoned, which is a division of application No. 10/524,001, filed as application No. PCT/IT03/00458 on Jul. 25, 2003, now Pat. No. 7,827,892.

(30) Foreign Application Priority Data

Aug. 9, 2002 (IT) ..... FI2002A0155

(51) Int. Cl.

| | |
|---|---|
| ***B26D 7/06*** | (2006.01) |
| ***B26D 3/16*** | (2006.01) |
| ***B26D 7/02*** | (2006.01) |
| *B26D 7/01* | (2006.01) |

(52) U.S. Cl.

CPC ..... *B26D 3/16* (2013.01); *B26D 3/161* (2013.01); *B26D 3/166* (2013.01); *B26D 7/02* (2013.01); *B26D 7/06* (2013.01); *B26D 7/0683* (2013.01); *B26D 2007/013* (2013.01); *Y10T 83/04* (2015.04); *Y10T 83/0524* (2015.04); *Y10T 83/303* (2015.04); *Y10T 83/6489* (2015.04); *Y10T 83/654* (2015.04); *Y10T 83/7755* (2015.04)

(58) Field of Classification Search

CPC ..... B26D 3/161; B26D 7/02; B26D 7/0683; B26D 2007/013; B26D 3/166; B26D 7/06; B26D 3/16; Y10T 83/303; Y10T 83/654; Y10T 83/7755; Y10T 83/04; Y10T 83/6489; Y10T 83/0524

USPC ... 83/155, 13, 407, 409, 483, 277, 272, 255, 83/174, 155.1, 401, 676, 411.6, 168, 83/411.5, 411.3, 108, 23, 112, 38, 37, 83/329, 39; 242/532.3, 533.1; 493/362

See application file for complete search history.

(56) References Cited

U.S. PATENT DOCUMENTS

| | | | | |
|---|---|---|---|---|
| 2,053,786 A * | 9/1936 | Straubel | B26D 3/161 225/2 |
| 3,905,260 A * | 9/1975 | Nystrand | B26D 3/16 83/155 |
| 4,043,231 A * | 8/1977 | Friedberg | A01G 9/1006 83/408 |
| 4,111,084 A * | 9/1978 | Matsumoto | B23B 5/16 82/100 |

(Continued)

*Primary Examiner* — Ghassem Alie

(74) *Attorney, Agent, or Firm* — McGlew and Tuttle, P.C.

(57) ABSTRACT

Apparatus for trimming paper rolls or logs (2) including: a section for the entry of the logs (2) to be trimmed; a section for the exit of the trimmed logs (2'); a station with cutting device (6) for trimming the logs (2); a device (3) for moving the logs (2, 2') between the entry section, the cutting station and the exit section; a device (4), associated with the log-moving device (3), for retaining the logs when subjected to movement.

10 Claims, 11 Drawing Sheets

(56) References Cited

U.S. PATENT DOCUMENTS

| | | | | | |
|---|---|---|---|---|---|
| 4,219,056 | A * | 8/1980 | Lindstrom | B27B 1/007 | 144/378 |
| 4,351,459 | A * | 9/1982 | Huey-Miin | C03B 33/06 | 225/2 |
| 4,558,617 | A * | 12/1985 | Boelen | B26D 1/0006 | 83/425.1 |
| 5,142,955 | A * | 9/1992 | Hale | B23D 59/008 | 144/356 |
| 5,845,871 | A * | 12/1998 | Lynch | B65H 75/10 | 242/609.4 |
| 2002/0038588 | A1* | 4/2002 | Newnes | B27B 1/007 | 83/75.5 |
| 2003/0037653 | A1* | 2/2003 | Betti | B26D 3/161 | 83/174 |

* cited by examiner

APPARATUS FOR TRIMMING PAPER ROLLS OR LOGS AND AN OPERATING METHOD FOR TREATING THE LOGS

CROSS REFERENCE TO RELATED APPLICATIONS

This application is a continuation application under 37 CFR 1.53(b) of pending prior application Ser. No. 12/145,700 filed Jun. 25, 2008 and claims the benefit under 35 U.S.C. § 120 of application Ser. No. 10/524,001 filed Feb. 8, 2005 and claims the benefit (35 U.S.C. § 120 and 365(c)) of International Application PCT/IT2003/000458 of Jul. 25, 2003, which designated inter alia the United States and which claims the priority of Italian Application FI2002A000155 of Aug. 9, 2002. The entire contents of each application is hereby incorporated by reference in its entirety.

FIELD OF THE INVENTION

The present invention refers to an apparatus for trimming paper rolls or logs and to an operating method for treating the logs.

BACKGROUND OF THE INVENTION

In the description that follows, the term paper rolls and, its equivalent term "logs" refer to rolls of web material (such as paper) wound up around a support core (e.g. a cardboard tubular core) to be cut in order to form rolls of smaller dimensions, that is, of commercial size.

The current production of small rolls of paper is known to include cutting transversely the logs produced by a rewinding machine and with the use of one or more cutting-off machines.

A cutting-off machine for logs is described in details in the document IT 1247330.

In practice, a cutting-off machine of this type includes:

- a plurality of channels or guides into which the logs are unloaded, and in correspondence of which movable devices, so-called "porters", are mounted and operated for moving longitudinally the logs by pushing them from the back;
- a cutting station, comprising one or more circular blades rotating about axes parallel to those of the logs and fixed onto a corresponding movable support; and
- means for discarding the waste, that is, the end trims produced in the cutting station.

During the normal operation, a log to be cut is disposed by a relevant porter unit in a preset position onto the respective guide, the same log is retained in such position, and one of the blades is operated, that is, is driven in a plane orthogonal to the log's axis, so as to form a shorter roll of preset size. The length of the small roll depends actually on the advancement of the porter unit during the time elapsing between two consecutive actuations of the blades.

The current production processes imply some degree of inaccuracy in the formation of the logs. In fact, the cores are likely either to project from the ends of the wound-up material or to result thereinside. Moreover, the end bases of the logs may result oblique with respect to the longitudinal axes thereof and their consistence may lack in uniformity.

In conclusion, the length of the logs is never the same, both owing to the process irregularities and to the deformations induced by the pressure exerted by the porter units onto poor-consistence bases of the logs, which deformations bring about errors in the advancement of the porter units and are thus the cause of inaccuracy on the lengths of the small rolls formed from the logs. Such inaccuracies result crucial when the cuts must be made at preset distances from printed pictures or other imprint figures formed on the paper of the logs.

Besides, the first and the last cuts, required for trimming the logs in correspondence of their two ends, generate waste or trims which must be detached from the small rolls before putting the latter on the market. Provision is made therefore for using means intended to separate the trims, which means are never totally efficient and their intervention is likely to prejudice the quality of the small rolls.

A further drawback related to this log-trimming technique lies in the poor quality of the trimming cuts: in order to keep the production waste at a minimum, the length of the trims is minimal but, owing to the lack of homogeneity of the material close to the end bases, the corresponding cuts are hardly ever orthogonal to the axis of the logs, so that, most of the times, for each log there are produced two imperfect small rolls (one for each end of the log), also due to the high cutting speed and to the shape of the chamfer of the blades. The result is that, generally, the adopted solution is a trade-off which fulfills only in part the requirements for the trimming and cutting-off of the logs.

SUMMARY OF THE INVENTION

The main object of the present invention is to overcome the above mentioned drawbacks.

This result has been achieved, according to the invention, by adopting the principles set forth in the independent claims.

Further characteristics being disclosed in the dependent claims.

The present invention makes it possible to simplify and improve the log-cutting process. Moreover, it allows to simplify the structure and operation of the cutting-off machines, as the section for the removal of the trims from the logs is unnecessary and, accordingly, it can be suppressed. In addition to this, the apparatus according to the invention is easy to make, cost-effective and reliable even after a prolonged service life.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
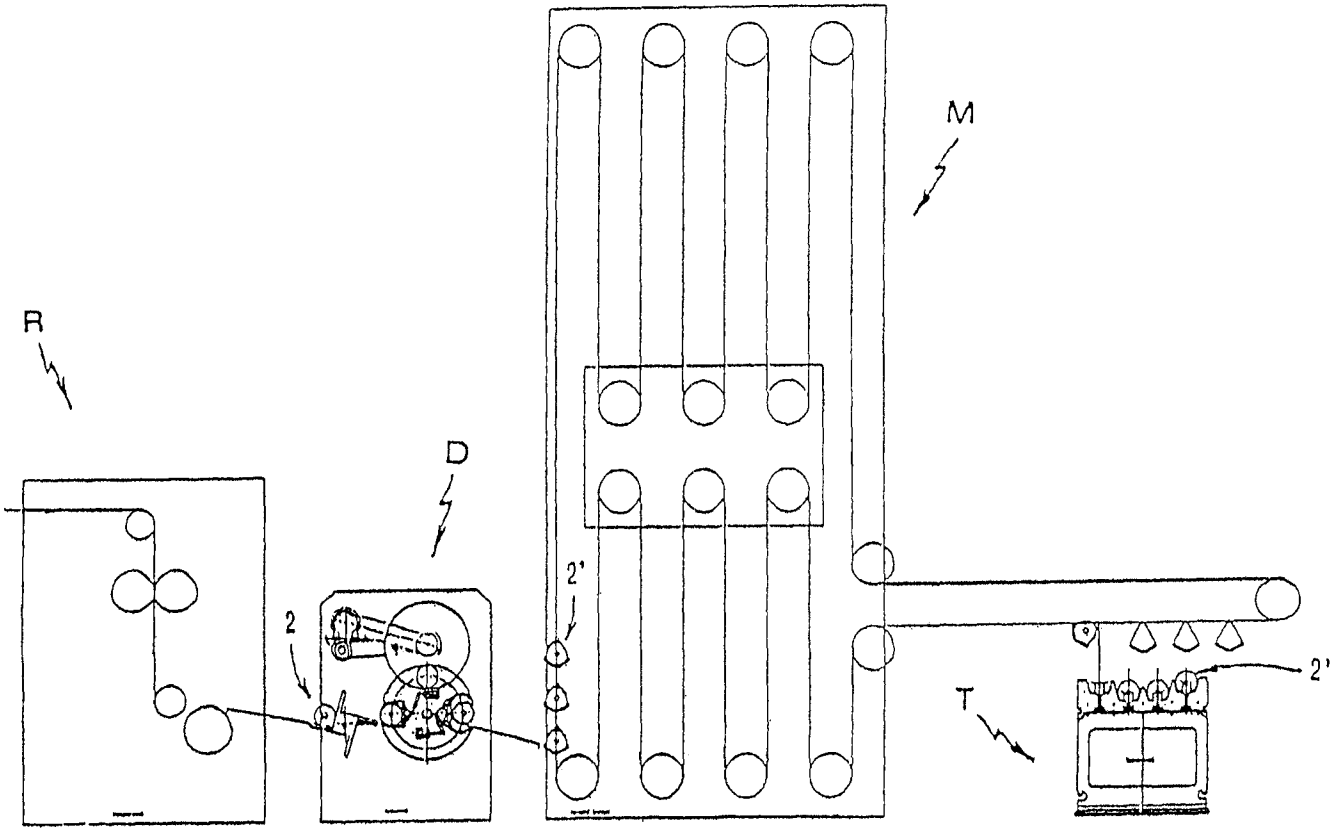
FIGS. 1-4 are schematic views showing different positions of an apparatus according to the invention within a plant for the production of paper rolls of commercial size.

Reduced to its basic structure, and reference being made to the FIGS. 5A-5F of the attached drawings, an apparatus (D) according to the invention comprises:

- A plane (1) for the entry of logs (2) produced upstream of a rewinder (R);
- a revolving unit (3) comprising a plurality of housings (30) for the logs (2) which come one at a time from the entry plane (I), and provided with means (4) for holding each log (2) in a corresponding housing (30) and respectively releasing it;
- means (5), disposed and acting between the entry plane (1) and the revolving unit (3), in order to transfer the logs (2) from the plane (1) to the revolving unit (3);
- cutting means (6) for trimming the logs retained within the housings (30) of the revolving unit (3), that is, for removing portions thereof of reduced extension in correspondence of their ends;
- a chute (7) downstream of the revolving unit (3), for unloading the trimmed logs (2').

By way of example, and with reference to the drawings, the means (5) intended for loading the revolving unit (3), that is, for transferring the logs (2) from the plane (1) to the housings (30) of the revolving unit (3), comprise a body (52) which has square cross-section, developed in a direction parallel to that of incoming logs (2), is provided with peripheral seats (50) with L-shape profile (in the example, the seats 50 are in number of four and orthogonal to each other) and is mounted on a central shaft (51) associated with a corresponding driving motor (not shown in the drawings) to allow the rotation thereof about the respective longitudinal axis. The body (52) is positioned on the respective shaft (51) in such a way that, while a wing (501) of a seat (50) is in line with the entry plane (1) of logs (20, a wing (502) of another seat (50) is in line with one of the housings (30) presented by the revolving unit (3).

Again with reference to the accompanying drawings, the means (4) for retaining the logs (2) within the housings (30) of the revolving unit (3) are gripper means. More in particular, the means comprise a gripper for each housing (30), each gripper comprising two arcuate jaws (40) associated with an actuator (41) via a connecting linkage (42). The grippers are intended to retain the logs (2) by clamping them in proximity of their ends bases which project slightly from the housings provided by the revolving unit (3). For this purpose, the grippers can be mounted on the bases (31) of the revolving unit (3).

As far as the cutting means (6) are concerned, they comprise, as shown in the drawings, two circular blades (60) located at a preset distance one from the other and acting on corresponding planes orthogonal to the longitudinal axis of each log (2) to be trimmed.

In the example, each blade (60) is associated with a relevant electric motor (61) via a drive belt (62). The motors (61) are disposed on supports (63) mounted on a horizontal guide (64) to allow at least one of them to be moved parallel to the logs (2) under treatment, and thus adjusting the position thereof, in relation to the length of the same logs (as indicated by the dual arrow "G"), by means of a corresponding adjustment handwheel (65). The blades (60) are mounted at the end of corresponding arms (66) which are cantilever-mounted with respect to the supports (63) of motors (61) and are able to pivot on hinges (660) parallel to the axes of the logs, that is, parallel to the guide (64), to allow the adjustment of the position of the blades (60) in the respective operating planes, as the same blades gradually wear out (with reduction of their diameter), by means of corresponding adjustment handwheels (67).

Also represented in the drawings are sharpening means with grinding wheels (68) in correspondence of blades (60) for the continuous sharpening of the latter during their rotation.

The cutting tool for operating the trimming of the logs (2) can be of any type.

Figure 7:
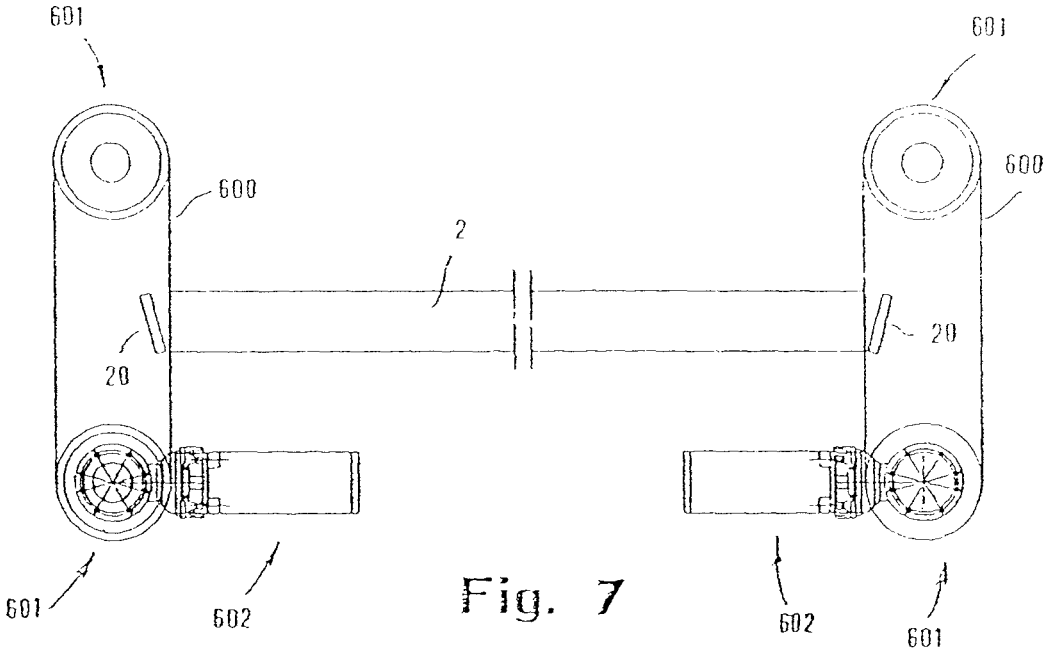
FIG. 7 is a view similar to that of FIG. 6, relating to an alternative embodiment of the invention.
Figure 8:
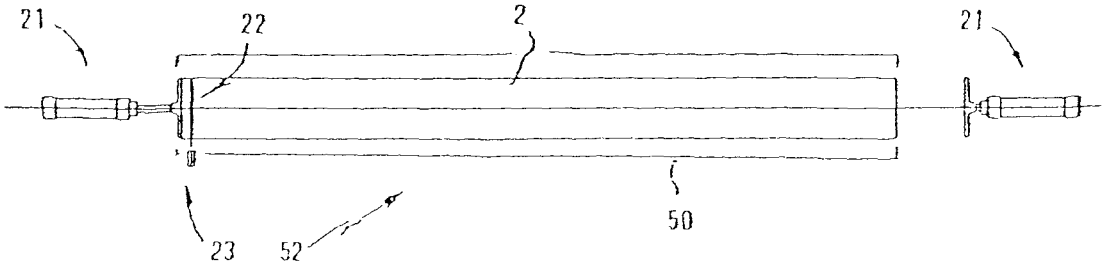
FIG. 8 is a schematic diagram relating to a step of longitudinal pre-positioning of a log.

For example, with reference to FIG. 7, in place of the circular blades (60), band blades (600) may be used which are loop-closed on corresponding driving-out pulleys (601) and associated with two electric motors (602) each of which drives a corresponding pulley (601) into rotation.

Figure 2:
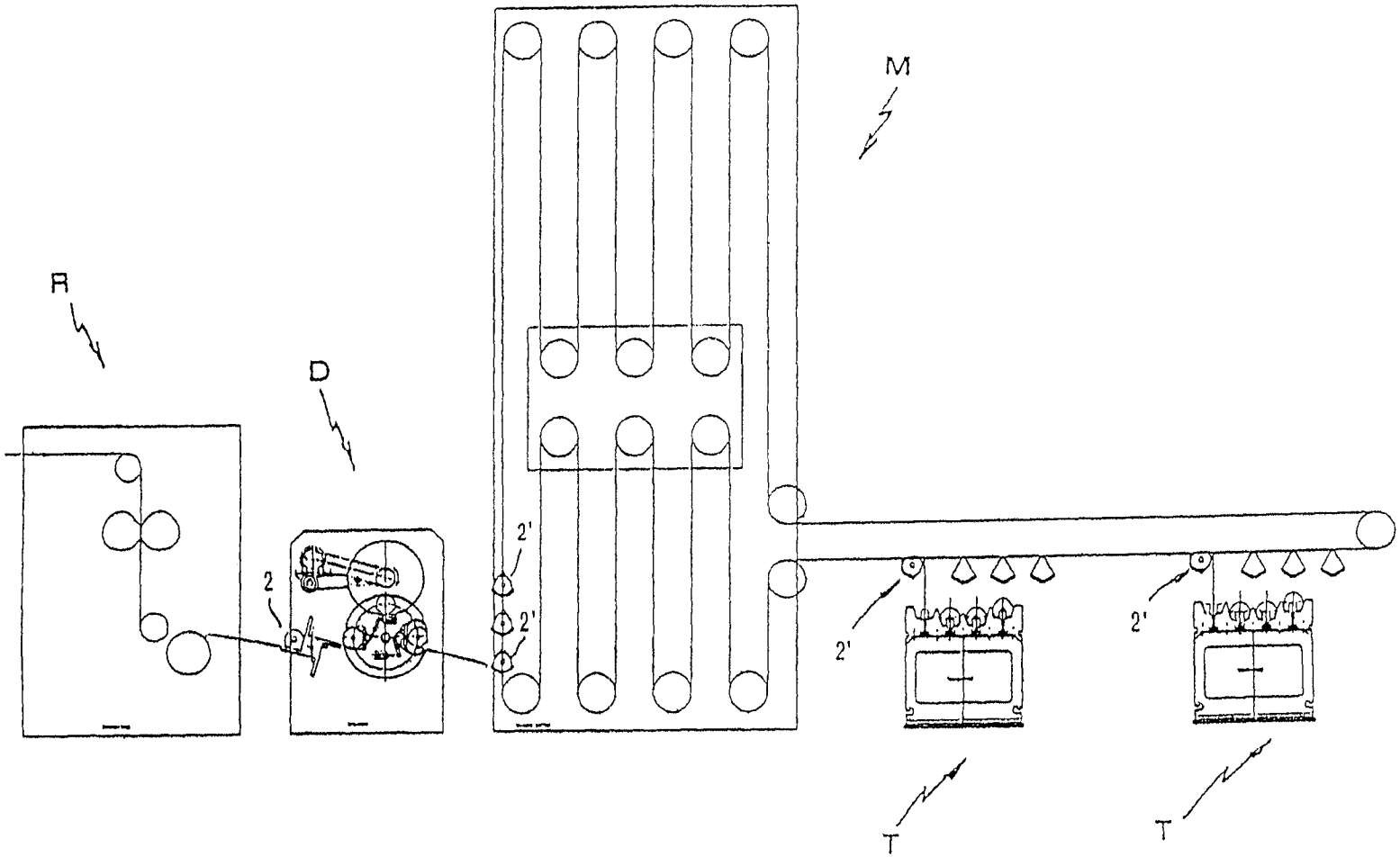
Figure 3:
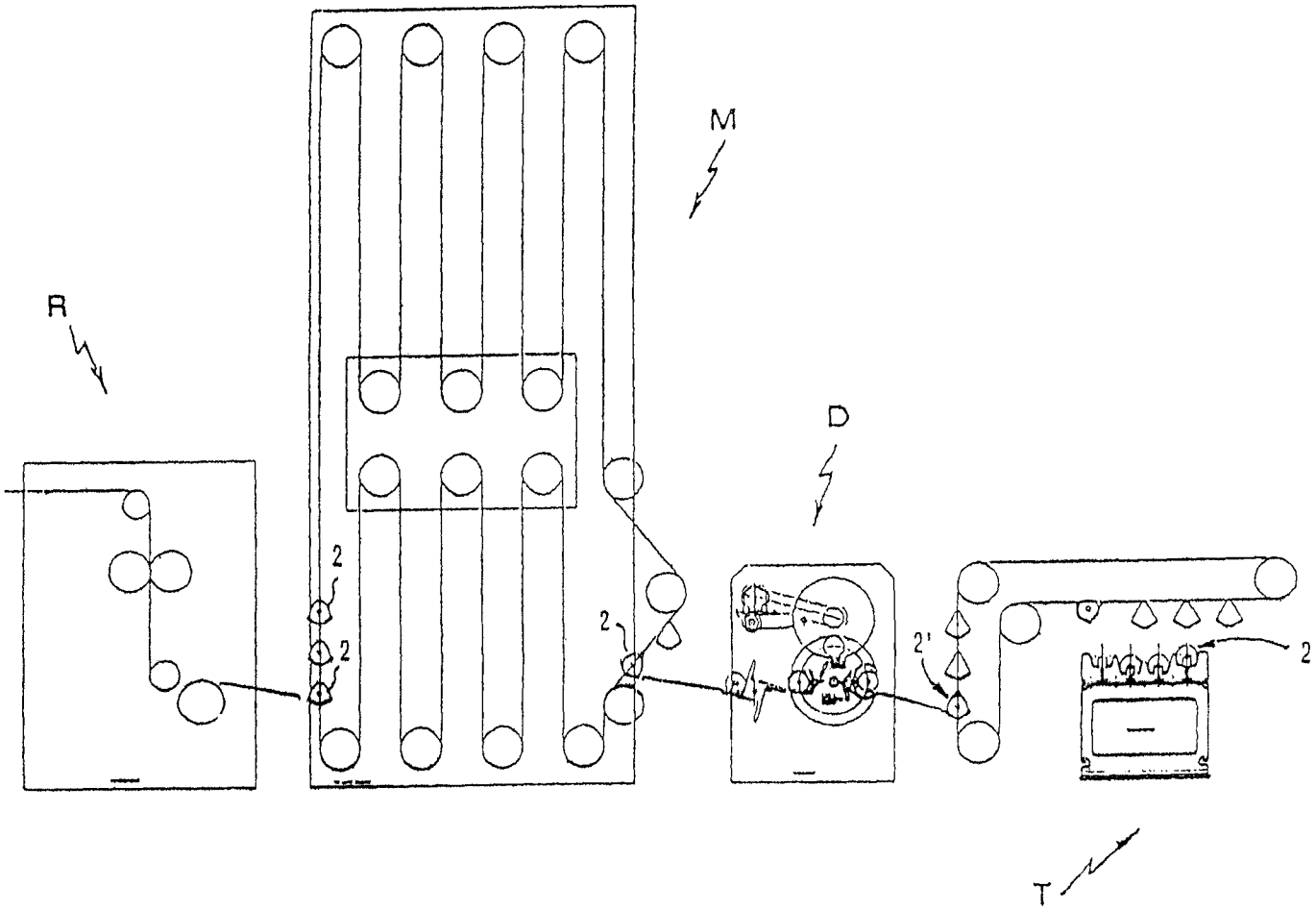
Figure 4:
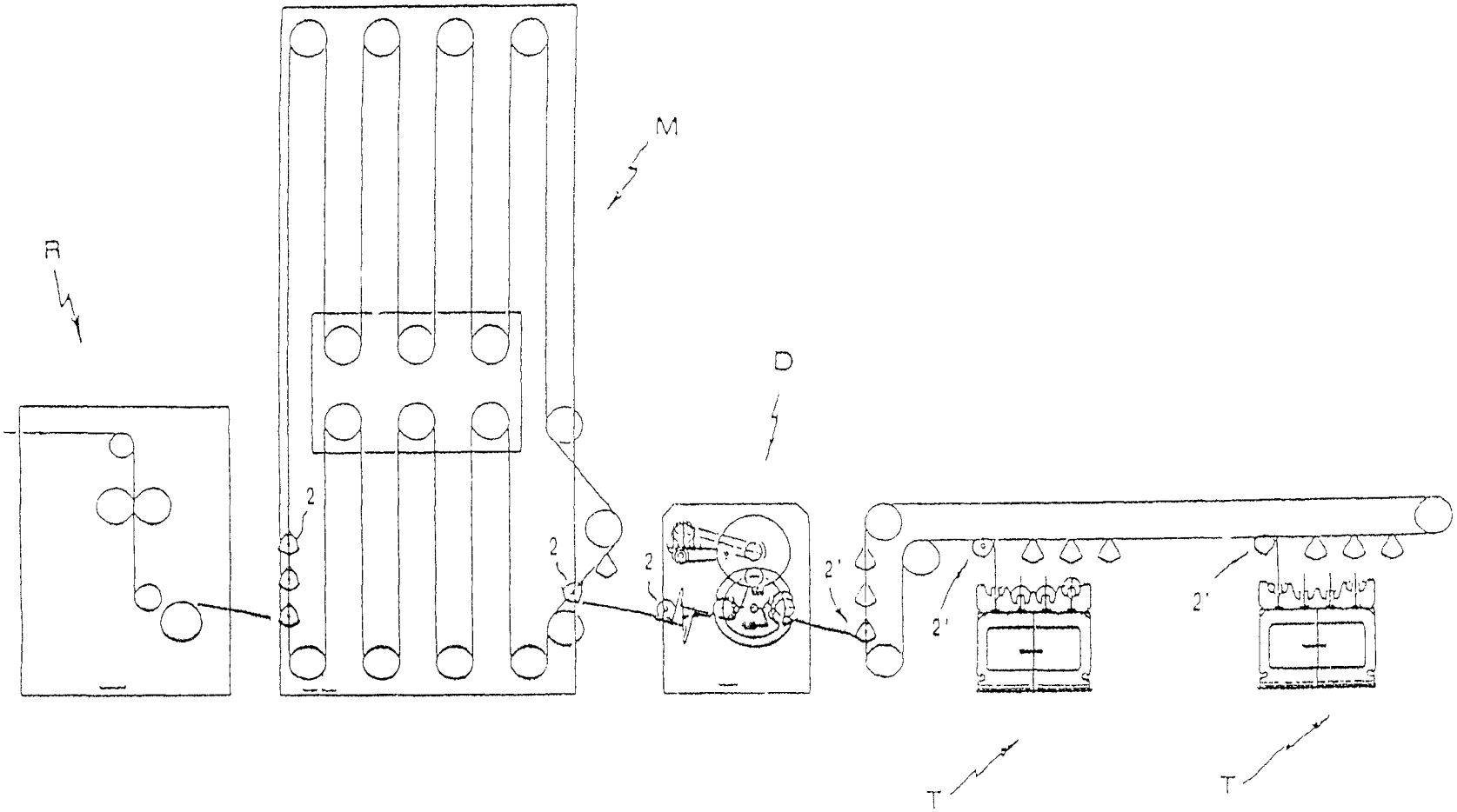

As illustrated in the schematic diagrams of FIGS. 1-4, an apparatus (D) according to the invention can be disposed both directly downstream of a rewinding machine (R) with associated means for closing the logs by glueing them—which machine is intended for the production of the logs (2)—as in FIGS. 1 and 2, and downstream of the a store (M) for the collection of logs, as in FIGS. 3 and 4.

In the first case, the trimmed logs (2') are fed into the store (M) which is located downstream of the apparatus (D) and, downstream of store (M) there are disposed one (FIG. 1) or two (FIG. 2) cutting-off machines (T) which receive from the store (M) the already trimmed logs (2') for dividing them into small rolls, that is, for dividing them into more elements of commercial size.

In the second case (FIGS. 3 and 4), the apparatus is disposed downstream of the store (M) and supplies one (FIG. 3) or two (FIG. 4) cutting-off machines (T).

In any case, the apparatus (D) is located upstream of one or more cutting-off machines (T) to which, therefore, come the already trimmed logs (2').

The structure and operation of the rewinding machines, of the stores and the cutting-off machines for the logs, are known to those skilled in the art and, therefore, a more detailed description thereof is omitted.

Figure 5A:
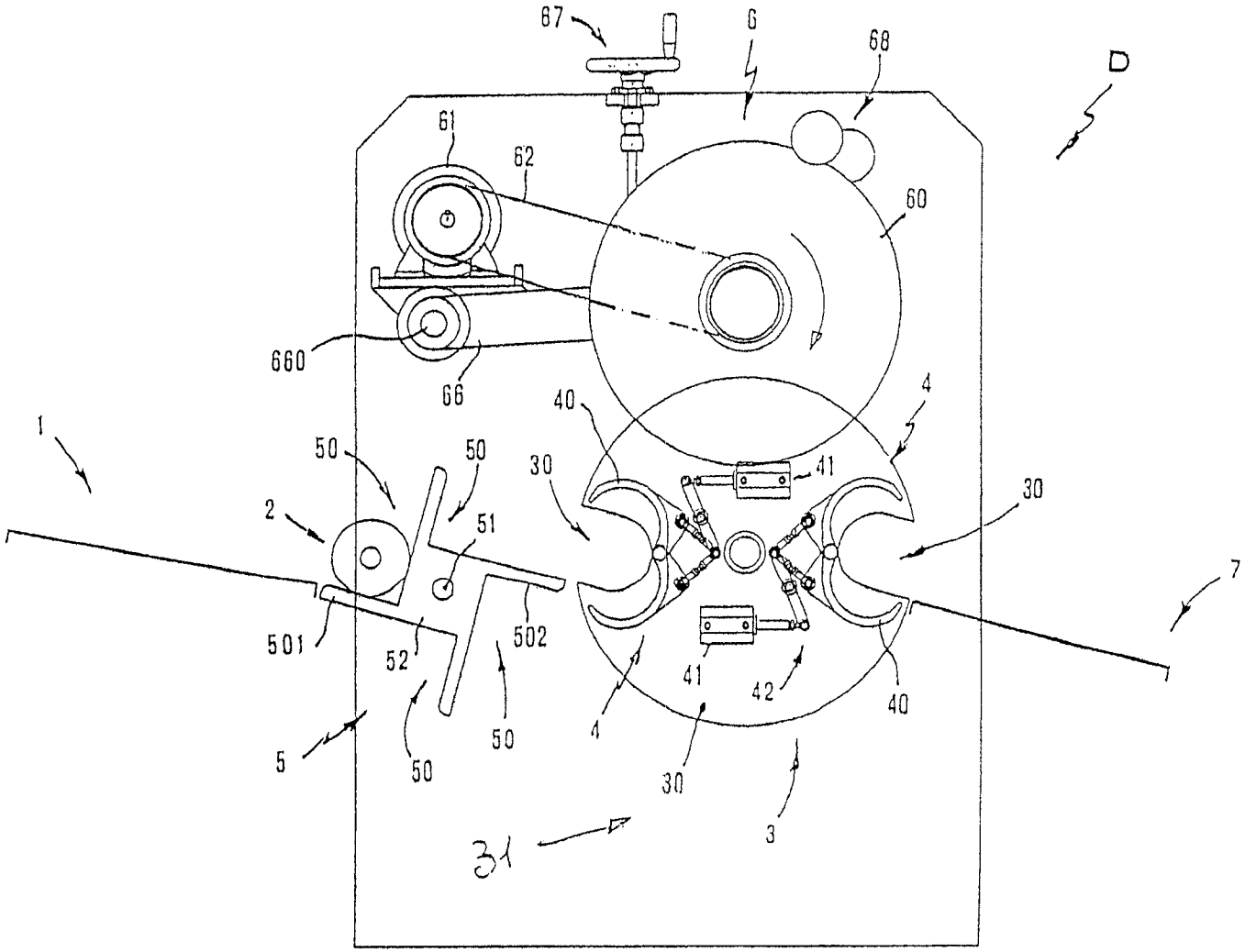
FIGS. 5A-5F are schematic side views in phantom of an apparatus according to the invention in a plurality of corresponding operating states.
Figure 5B:
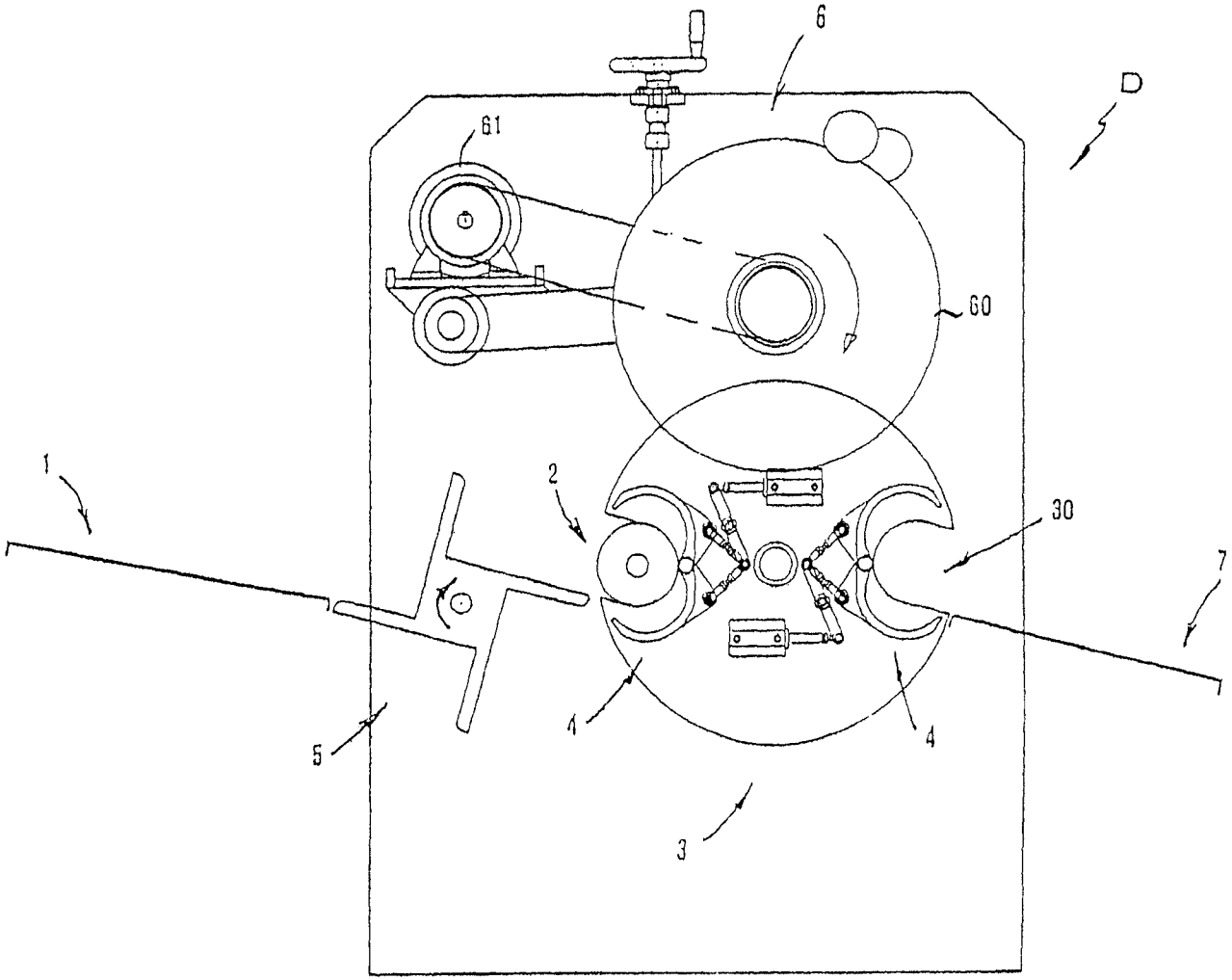
Figure 5C:
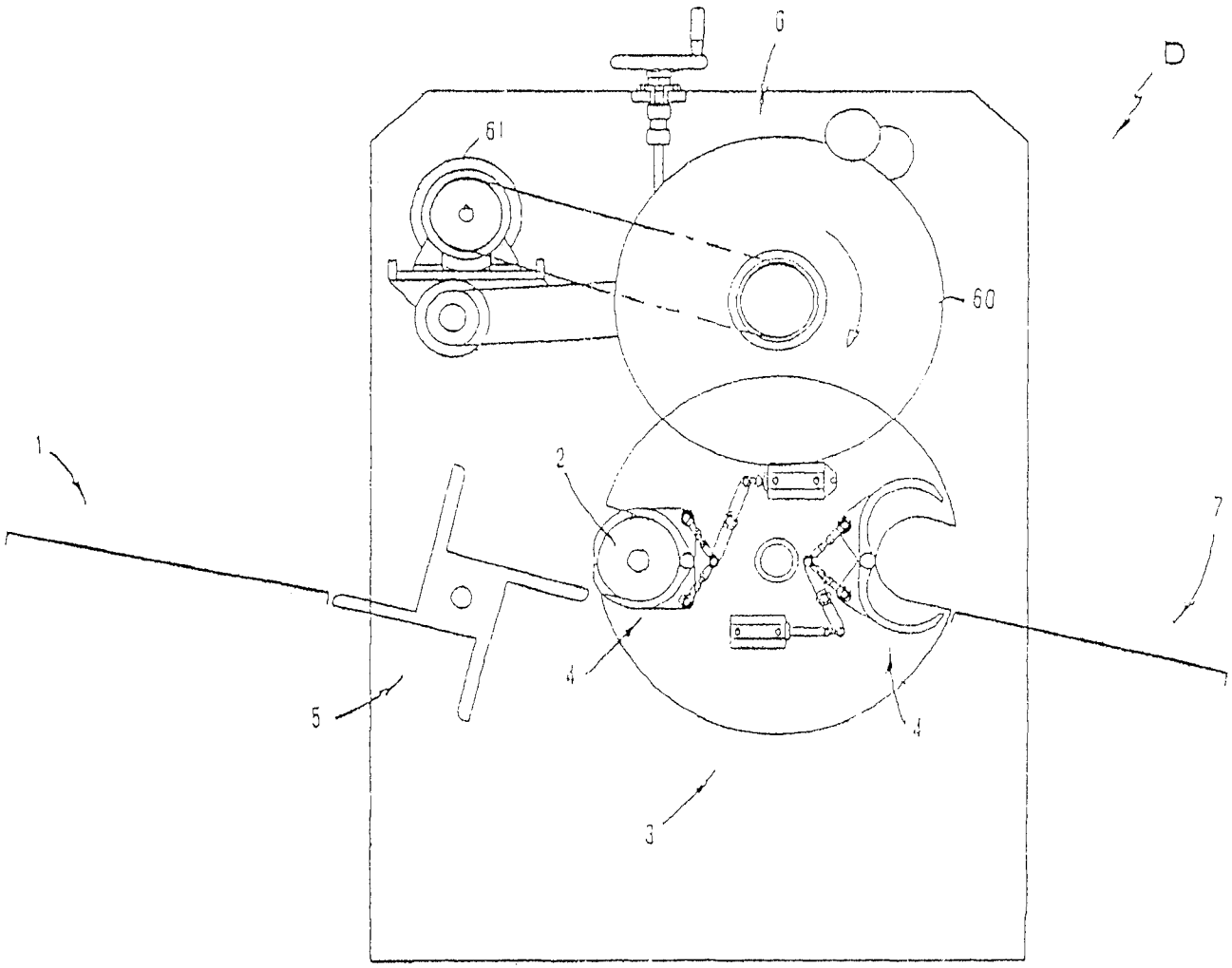
Figure 5D:
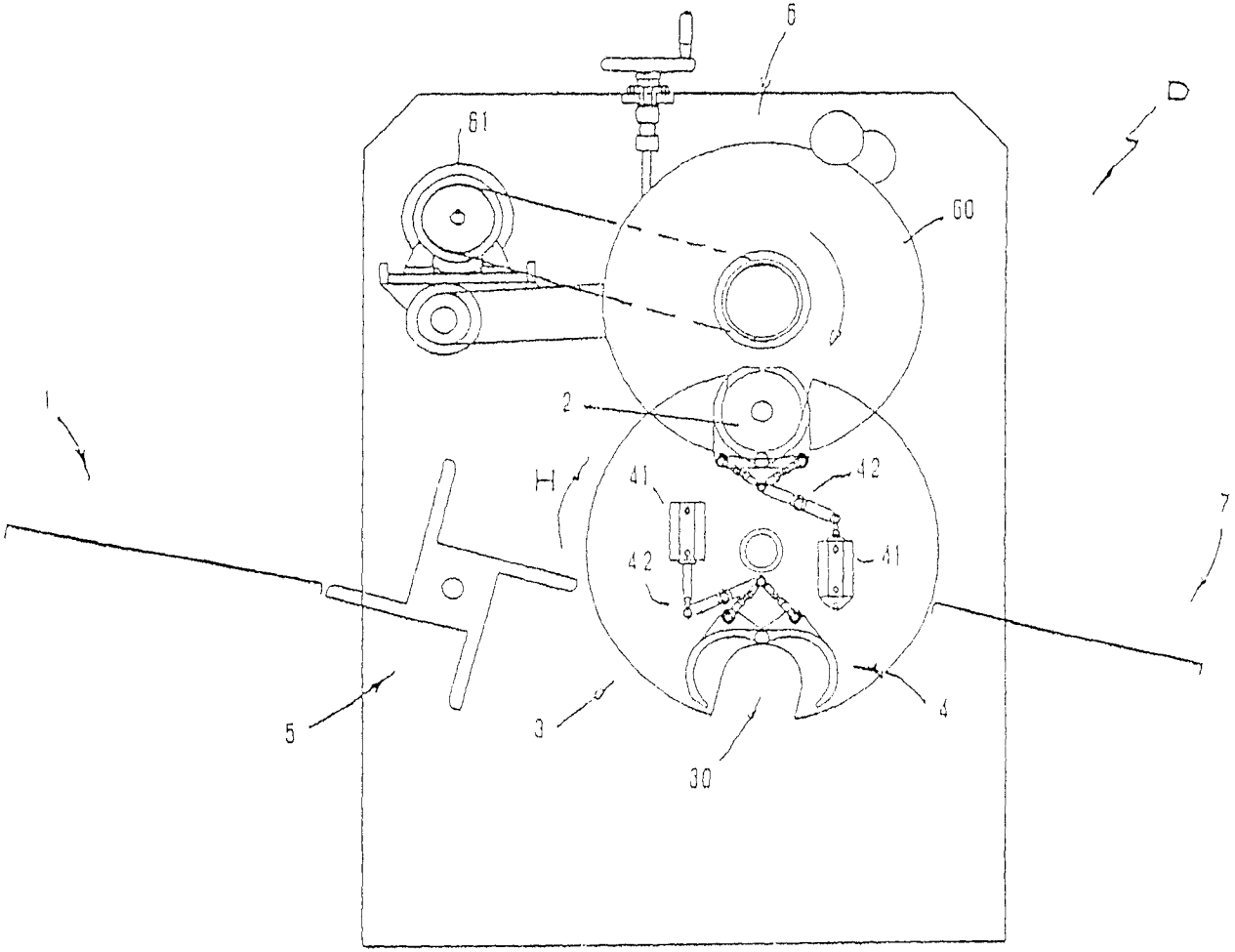
Figure 5E:
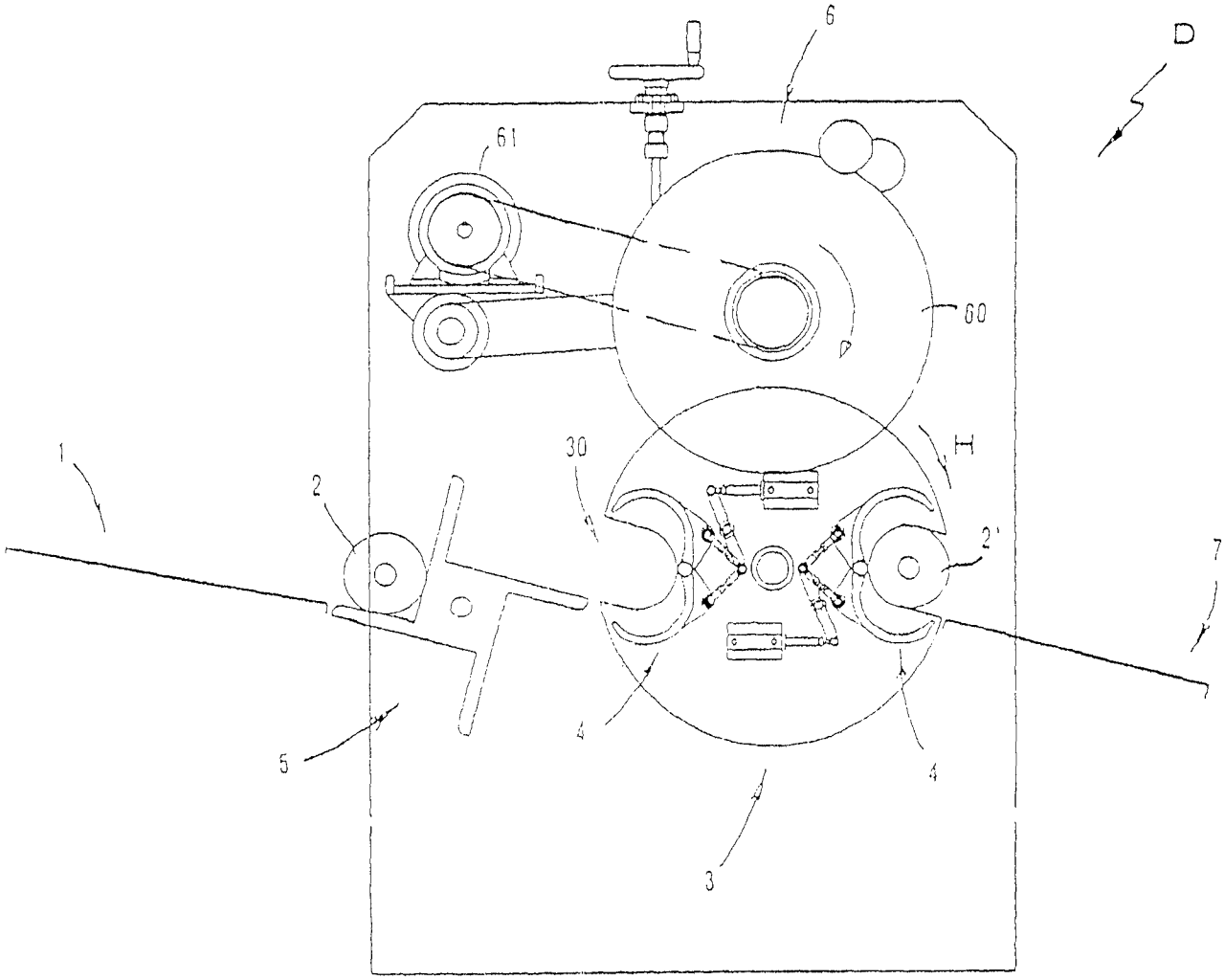
Figure 5F:
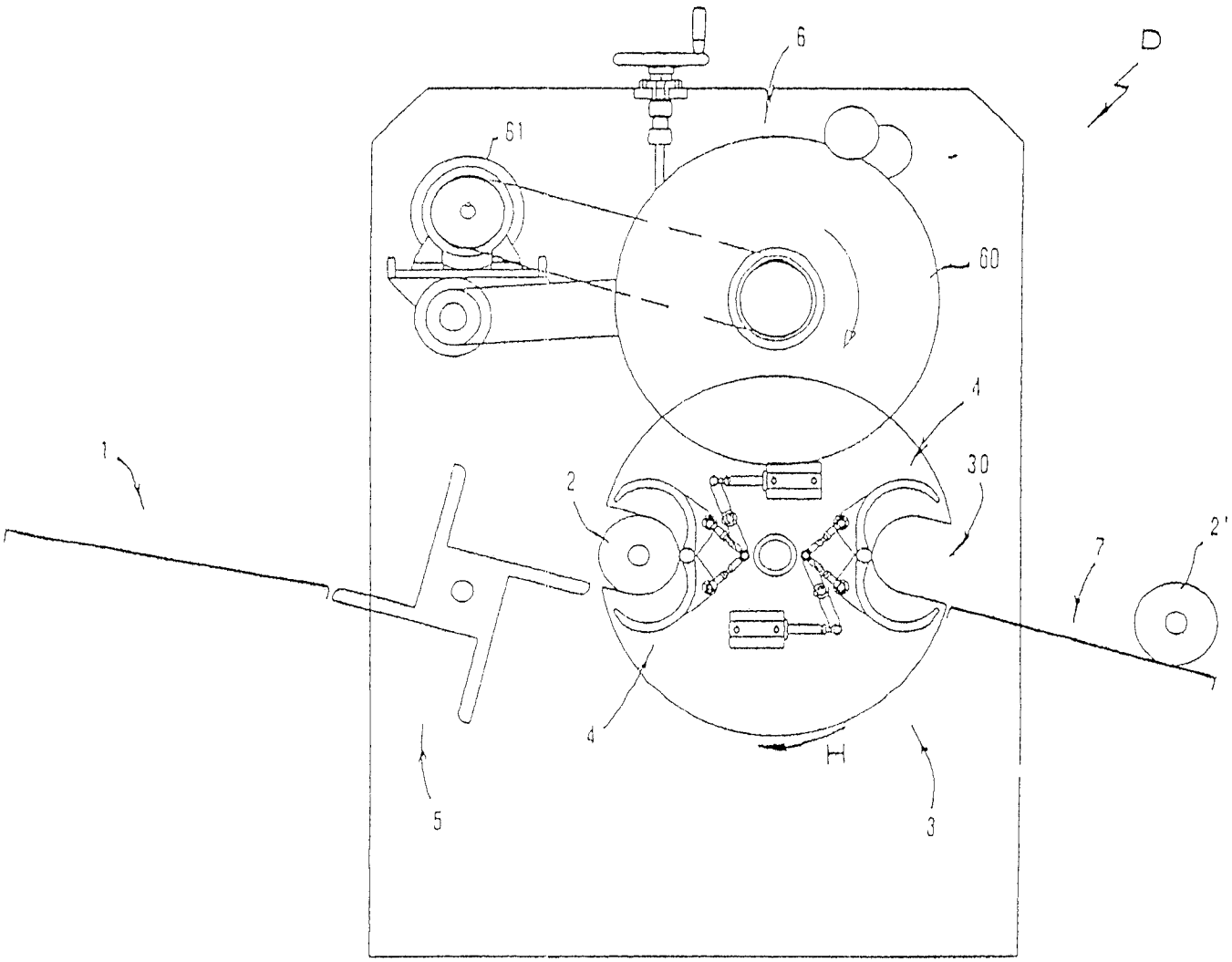
Figure 6:
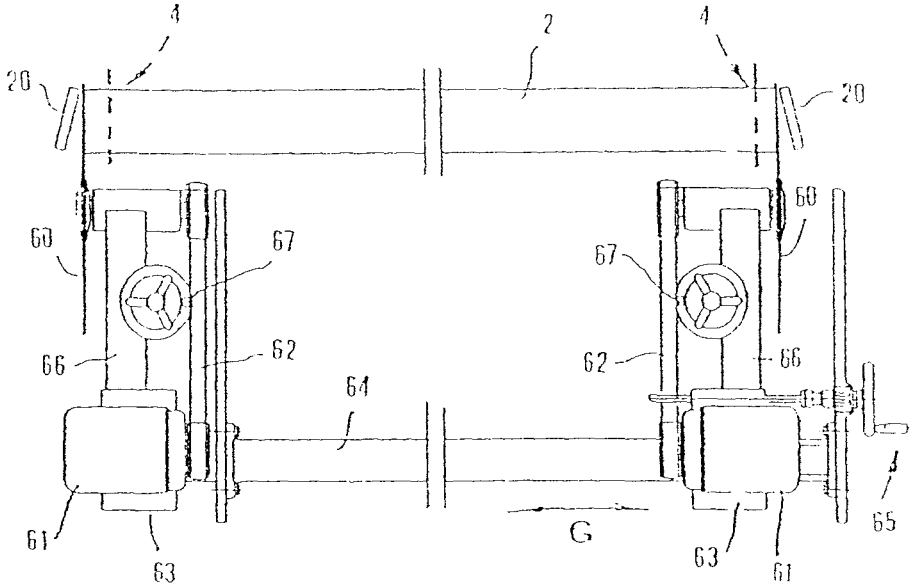
FIG. 6 is a schematic plan view of an apparatus according to the invention.

The normal operating condition of the apparatus (D), reference being made to the drawings of FIGS. 5A-6, is as follows.

A log (2) to be trimmed runs along the plane (1) by rolling over it until it results disposed within a seat (50) of the body (52) in a stand-by condition (FIG. 5A). In this location a step of longitudinal positioning the log (2) takes place by means of pneumatic pushers (21) disposed in line with the log (2) and acting on the bases thereof, so that a reference of the same log (for example, a colored line 22 or a figure printed on the paper of the logs) will result aligned with a fixed reference (e.g. one or more photo-transducers 23 located at a fixed position with respect to the body 52). At this point, the body (52) is rotated through 90°, so that the seat (50) of body (52) which houses the log will result in front of a housing (30) of the standing-by revolving unit (3) and, because of the inclination of the wing (502) of seat (52), the log (2) rolls towards and up to the housing (30) (FIG. 5B). Thereafter (FIG. 5C), the jaws (40) of the gripper associated with the housing (30) which now receives the log (2) clamp the latter (FIG. 5C) and the revolving unit revolves (arrow "H") in order to dispose the log in the cutting position under the blades (60) (FIG. 5D). During the revolving of the unit (3) the trimming of the logs takes place with the removal of a reduced portion thereof in correspondence of both their ends, as schematically represented also in FIG. 6. By a further revolution of the unit (3), as indicated in FIG. 5E, the log (2') thus trimmed is moved on in correspondence of the unloading chute (7), while the other housing (30) of the revolving unit (3) results in front of the body (52) which, in the meantime, has received another log (2) to be trimmed. At this point, the jaws of the gripper which retains the trimmed log (2') open up, thereby releasing the log (2') which can roll along the discharge plane (7) (FIG. 5F). The cycle is then repeated identically.

The trimming step can be performed over a time longer than that spent for the same operation made by the common cutting-of f machines. Besides, since the blades (60) are specifically intended for trimming the logs and not also for their cutting-off, the shape of the relevant chamfers can be chosen among those most suited for this specific work.

A process according to the invention provides in practice for supplying one or more cutting-off machines (T) with logs (2') already trimmed, which can be made by having a log-trimming apparatus located upstream of the same cutting-off machines (T).

In this way, the small rolls produced by the cutting-off machines result with no trim to be separated and, since the logs (2') fed to the machines are already trimmed, they have the desired constant dimensional and consistence characteristics in correspondence of their bases. In addition to this, the production of the trims (20) and, consequently, the collection thereof, takes place only in correspondence of the apparatus (D) and not also in correspondence of the cutting-off machines (T), thereby improving the trims-recover and disposal operations. Moreover, as it is possible to use cutting-off machines with no trimming and trim-removal means, the manufacturing of such machines is simpler and more economical.

Practically, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

While specific embodiments of the invention have been shown and described in detail to illustrate the application of the principles of the invention, it will be understood that the invention may be embodied otherwise without departing from such principles.

What is claimed is:

1. A method for treating elongated paper rolls, the method comprising the steps of:

providing a cutting-off machine;

providing elongated paper rolls;

providing a trimming device;

moving said elongated paper rolls in a direction of said cutting-off machine; and trimming said elongated paper rolls with said trimming device to form trimmed paper rolls before said elongated papers rolls are supplied to said cutting-off machine, wherein said cutting-off machine receives said trimmed paper rolls, said cutting-off machine being actuated independent of said trimming device, wherein said cutting-off machine comprises cutting-off machine trimmed paper rolls longitudinal channels, said trimming device comprising an elongated paper rolls receiving housing, said elongated paper rolls receiving housing being located at a spaced location from said cutting-off machine trimmed paper rolls longitudinal channels, said elongated paper rolls receiving housing comprising an elongated paper roll gripping device, said elongated paper roll gripping device gripping one of said paper rolls, wherein said paper rolls receiving housing is rotated in a circumferential direction with respect to a longitudinal axis of said elongated paper rolls receiving housing as said one of said elongated paper rolls is trimmed via said trimming device.

2. A method according to claim 1, wherein said trimming device comprises a first actuating mechanism, said cutting-off machine comprising a second actuating mechanism, said first actuating mechanism being actuated independent of said second actuating mechanism.

3. A method according to claim 1, further comprising the steps of:

providing a rewinding machine;

providing a paper roll storage element;

producing said elongated uncut paper rolls with said rewinding machine;

storing said uncut paper rolls in said paper roll storage element; and delivering said uncut paper rolls from said paper roll storage element to said trimming device.

4. A method according to claim 3, wherein said rewinding machine is located upstream of said paper roll storage element, said trimming device being located downstream of said rewinding machine and said paper roller storage element, said cutting-off machine being located downstream of said rewinding machine, said paper roll storage element and said trimming device.

5. A method according to claim 4, wherein said trimming device trims at least one end of each elongated paper rolls to form said trimmed paper rolls.

6. A method according to claim 5, wherein said rewinding machine forms said elongated paper rolls, wherein said elongated paper rolls are moved from said rewinding machine to said paper roll storage element and said elongated paper rolls are moved from said paper roll storage element to define an elongated paper roll path, said trimmed paper rolls being moved from said trimming device to said cutting-off machine to define a trimmed paper roll path.

7. A method for treating paper rolls, the method comprising the steps:

providing a rewinding machine;

providing a first cutting device;

providing a second cutting device, said second cutting device being detached from said first cutting device;

forming uncut paper rolls with said rewinding machine;

moving said uncut paper rolls in a direction of said second cutting device;

cutting each of said uncut paper rolls with said first cutting device, independent of said second cutting device, to form trimmed paper rolls prior to said second cutting device receiving said paper rolls; and cutting each of said trimmed paper rolls with said second cutting device to form a plurality of subdivided paper rolls, wherein said second cutting device is operated independent of said first cutting device, each of said subdivided rolls having a length that is less than a length of each of said trimmed paper rolls, wherein said first cutting device comprises a paper rolls receiving housing, said second cutting device comprising a trimmed paper rolls receiving structure, said trimmed paper rolls receiving structure being separate from said log receiving housing, said paper rolls receiving housing comprising a paper roll gripping device, said paper roll gripping device gripping one of said paper rolls, wherein said paper rolls receiving housing is rotated in a circumferential direction with respect to a longitudinal axis of said paper rolls receiving housing as said one of said elongated paper rolls is trimmed via said first cutting device.

8. A method according to claim 7, further comprising the steps of:

providing a paper roll storage element;

storing said uncut paper rolls in said paper roll storage element; and delivering said uncut paper rolls from said paper roll storage element to said first cutting device, said first cutting device trimming at least one end of said uncut paper rolls to form said trimmed paper rolls.

9. A method according to claim 8, wherein said rewinding machine is located upstream of said paper roll storage element, said first cutting device being located downstream of said rewinding machine and said paper roller storage element, said second cutting device being located downstream of said rewinding machine, said paper roll storage element and said first cutting device.

10. A method according to claim 9, wherein said uncut paper rolls are moved from said rewinding machine to said paper roll storage element and said uncut paper rolls are moved from said paper roll storage element to define an uncut paper roll path, said trimmed paper rolls being moved from said first cutting device to said second cutting device to define a trimmed paper roll path.

* * * * *